US011766868B2

(12) United States Patent
Yoshikawa et al.

(10) Patent No.: US 11,766,868 B2
(45) Date of Patent: Sep. 26, 2023

(54) EJECTION APPARATUS AND WIPING METHOD

(71) Applicant: CANON KABUSHIKI KAISHA, Tokyo (JP)

(72) Inventors: Hirokazu Yoshikawa, Kanagawa (JP); Toshiyuki Chikuma, Tokyo (JP); Kei Kosaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 17/588,047

(22) Filed: Jan. 28, 2022

(65) Prior Publication Data

US 2022/0258474 A1 Aug. 18, 2022

(30) Foreign Application Priority Data

Feb. 17, 2021 (JP) ..... 2021-023543

(51) Int. Cl.
*B41J 2/165* (2006.01)

(52) U.S. Cl.
CPC ..... *B41J 2/16535* (2013.01); *B41J 2/16538* (2013.01)

(58) Field of Classification Search
CPC ..... B41J 2/16535; B41J 2/16538
See application file for complete search history.

(56) References Cited

U.S. PATENT DOCUMENTS 7,052,106 B1 * 5/2006 Onuma ..... B41J 2/16511 347/29
2007/0115318 A1 5/2007 Nishizaki et al.

FOREIGN PATENT DOCUMENTS

JP 2020059138 A * 4/2020 ..... B41J 2/16511

* cited by examiner

*Primary Examiner* — Sharon Polk
(74) *Attorney, Agent, or Firm* — Canon U.S.A., Inc. I.P. Division

(57) ABSTRACT

An ejection apparatus includes an ejection head having an ejection port surface and configured to eject a liquid to a recording medium for recording, a wiper configured to wipe the surface, and a moving unit configured to relatively move the wiper and the head to move the wiper in a first direction along the surface with respect to the head. The apparatus performs a first mode for performing the wiping while relatively moving the wiper and the head at a first speed, and a second mode for performing the wiping while relatively moving the wiper and the head at a second speed higher than the first speed. When the apparatus performs the wiping after the recording and then performs subsequent recording, the apparatus performs the second mode. When the apparatus performs the wiping after the recording and then performs no subsequent recording, the apparatus performs the first mode.

17 Claims, 16 Drawing Sheets

FIG.8

| | | CR STOP POSITION [SLIT] | STATE BETWEEN CAP AND HEAD |
|---|---|---|---|
| RECOVERY | CAP CLOSED POSITION | 0 | CONTACT |
| | WIPE TRIGGER POSITION | 50 | CONTACT |
| | WIPING PRELIMINARY EJECTION POSITION | 100 | NON-CONTACT |
| | CAP OPEN POSITION | 150 | NON-CONTACT |
| | WIPE TRIGGER RELEASE POSITION | 700 | NON-CONTACT |
| CARRIAGE HEIGHT ADJUSTMENT | RAISING PREPARATION POSITION | 200 | NON-CONTACT |
| | LOWERED POSITION | 300 | NON-CONTACT |
| | RAISED POSITION | 400 | NON-CONTACT |
| | LOWERING PREPARATION POSITION | 500 | NON-CONTACT |

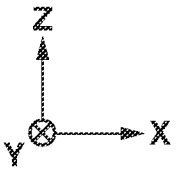
FIG.9C
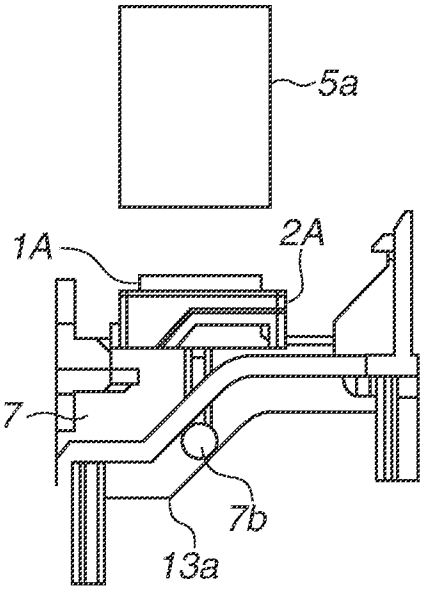
FIG.9B
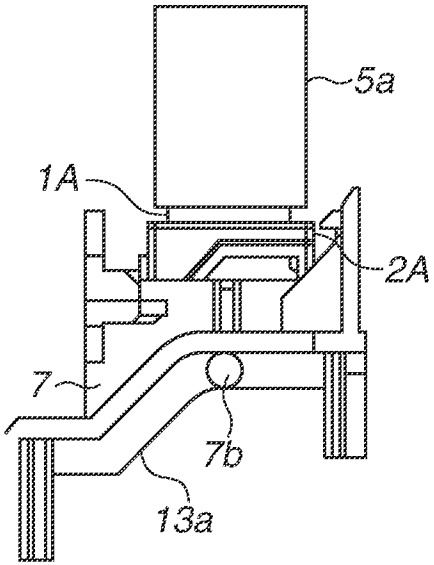
FIG.9A
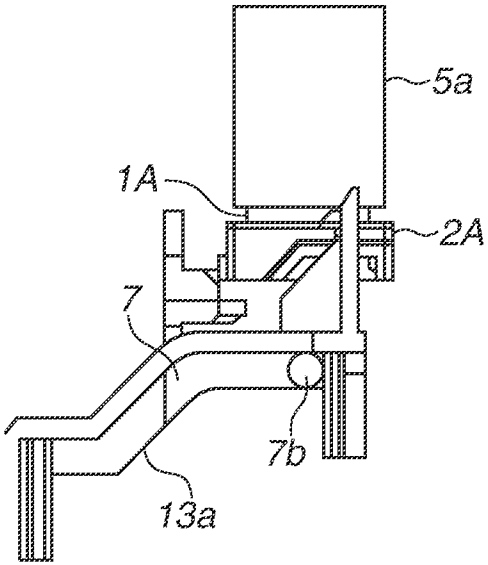

EJECTION APPARATUS AND WIPING METHOD

BACKGROUND OF THE DISCLOSURE

Field of the Disclosure

The present disclosure relates to an ejection apparatus and a wiping method.

Description of the Related Art

There is known an inkjet recording apparatus in which an ejection port surface is wiped by a blade that moves relative to the ejection port surface in order to maintain the state of ejection of ink from ejection ports.

United States Patent Application Publication No. 2007/0115318 discusses a configuration in which a step portion is formed in a recording head as a portion for accumulating foreign matter such as ink mist. The step portion is closer to a wiping start position than ejection ports, and the blade crosses the step portion to wipe an ejection port surface.

If the wiping is performed using the method according to United States Patent Application Publication No. 2007/0115318, the accumulating ink attaches to the blade and is drawn out and the drawn out ink remains as an ink drop on the ejection port surface, which can cause an ejection failure.

The ink drop remaining on the ejection port surface can be pulled into a nearby ejection port after some time, but this requires a standby time. For example, when the wiping is performed using the above-described method in a period after the end of recording on a first sheet of a recording medium and before the start of recording on a second sheet of the recording medium, it takes time before the start of recording on the second sheet, and this may impair user convenience.

SUMMARY OF THE DISCLOSURE

According to an aspect of the present disclosure, an ejection apparatus includes an ejection head having an ejection port surface on which ejection ports for ejecting a liquid are arranged, and a recessed portion that is recessed lower than at least the ejection port surface and is located at a position different from a position of the ejection port surface on a side having the ejection port surface, the ejection head being configured to eject the liquid to a recording medium to perform recording on the recording medium, a wiping member configured to wipe the ejection port surface, and a moving unit configured to move the wiping member and the ejection head relative to each other so as to move the wiping member in a first direction along the ejection port surface with respect to the ejection head, by moving at least one of the wiping member or the ejection head. The wiping member performs a wiping operation for wiping the ejection head to wipe the ejection port surface after passing the recessed portion. The ejection apparatus performs a first wipe mode for performing the wiping operation while moving the wiping member and the ejection head relative to each other at a first speed, and a second wipe mode for performing the wiping operation while moving the wiping member and the ejection head relative to each other at a second speed higher than the first speed. In a case where the ejection apparatus performs the wiping operation after the recording on the recording medium and then performs subsequent recording on the recording medium, the ejection apparatus performs the wiping operation in the second wipe mode. In a case where the ejection apparatus performs the wiping operation after the recording on the recording medium and then performs no subsequent recording on the recording medium, the ejection apparatus performs the wiping operation in the first wipe mode.

Further features of the present disclosure will become apparent from the following description of exemplary embodiments with reference to the attached drawings.

BRIEF DESCRIPTION OF THE DRAWINGS

FIG. 8 illustrates a list of carriage stop positions according to the present exemplary embodiment.

FIGS. 9A to 9C are front views each illustrating a state between a cap and the recording head when a carriage is at one of the stop positions according to the present exemplary embodiment.

DESCRIPTION OF THE EMBODIMENTS

Exemplary embodiments of the present disclosure will be described below with reference to the attached drawings.

Figure 1:
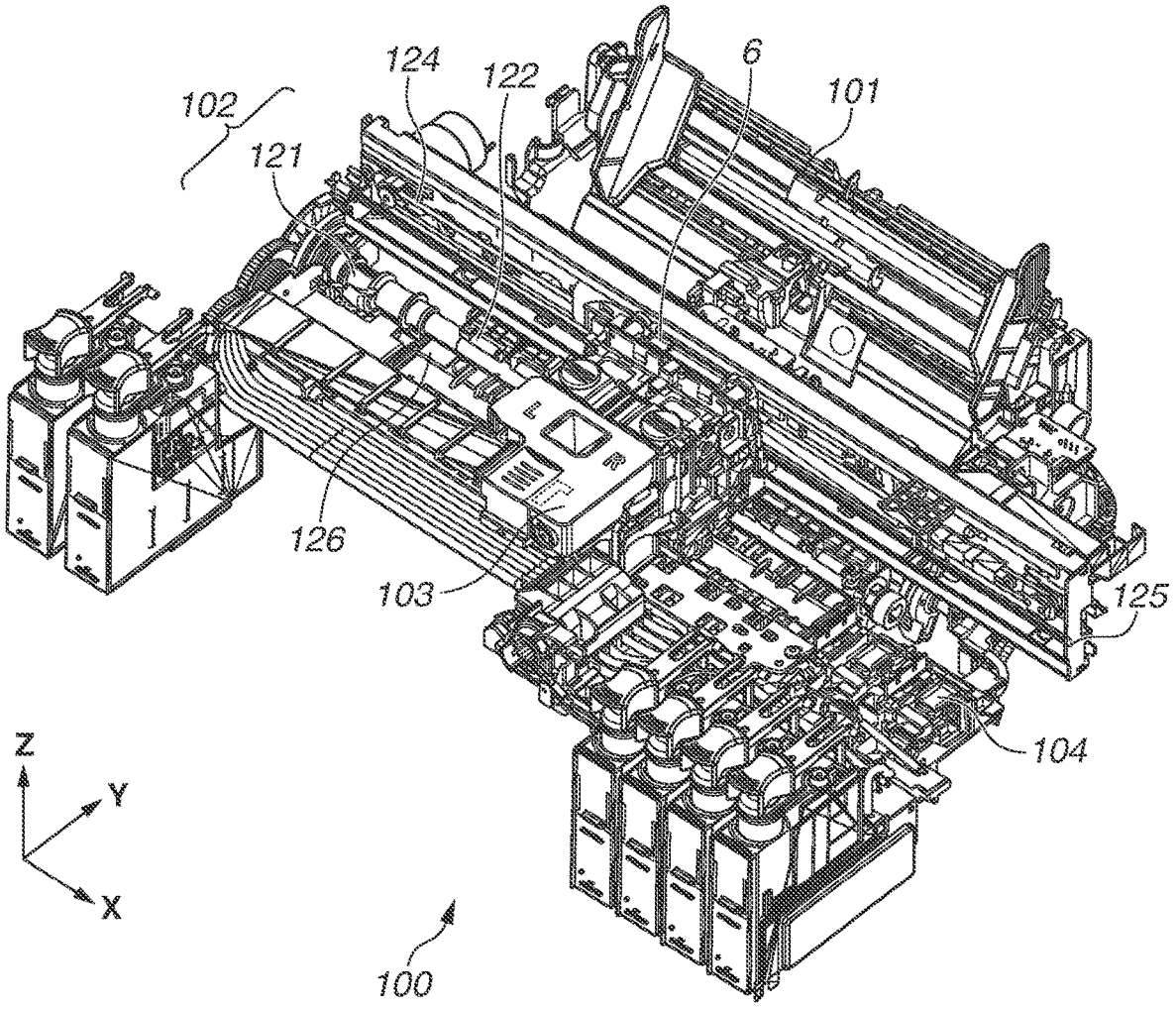
FIG. 1 is a perspective view of a recording apparatus according to an exemplary embodiment of the present disclosure.

FIG. 1 is a perspective view of an internal configuration of an inkjet recording apparatus 100 according to an exemplary embodiment of the present disclosure.

As illustrated in FIG. 1, the inkjet recording apparatus 100 (hereinafter also simply referred to as the recording apparatus 100) includes a sheet feed unit 101, a conveyance unit 102, a recording mechanism unit 103, and a recovery mechanism unit 104. The sheet feed unit 101 feeds a recording medium such as recording paper into a main body of the recording apparatus 100. The conveyance unit 102 conveys the recording medium fed by the sheet feed unit 101 in a −Y direction. The recording mechanism unit 103 operates based on image information, and records an image on the recording medium. The recovery mechanism unit 104 maintains or recovers ink ejection performance of recording heads 5 (5*a* and 5*b* in FIG. 2).

Sheets of the recording medium stacked in the sheet feed unit 101 are separated one by one by a feed roller driven by a sheet feed motor 4013 (see FIG. 4), and fed to the conveyance unit 102. The recording medium fed to the conveyance unit 102 is conveyed onto a platen 126 while being held by a conveyance roller 121 and a pinch roller 122 driven by the sheet feed motor 4013. On the recording medium conveyed onto the platen 126, recording is performed by the recording mechanism unit 103. The recording mechanism unit 103 performs the recording by driving a carriage 6 on which the recording heads 5 (see FIG. 3) are mounted and which moves in a main scanning direction (an X direction), based on image information, and ejecting ink from ejection ports of the recording heads 5. The recording heads 5 and liquid containers 30 (30*a* and 30*b* in FIG. 2) containing the ink are connected by a supply tube 31 (see FIG. 2) to supply the ink to the recording heads 5. The recording medium subjected to the recording is conveyed while being held between a sheet discharge roller and a spur roller, which are driven in synchronization with the conveyance roller 121, so that the recording medium is discharged to the outside of the main body of the recording apparatus 100.

The recording mechanism unit 103 includes the carriage 6 capable of reciprocating in the main scanning direction (the X direction), and the recording heads 5 mounted on the carriage 6. The carriage 6 is supported and guided so as to be able to reciprocate along a guide rail disposed in the main body of the recording apparatus 100. The carriage 6 is driven to reciprocate by a carriage motor 4011 (see FIG. 2) via a carriage belt 124.

The reciprocation of the carriage 6 is controlled by detection of a position and a speed of the carriage 6 using an encoder sensor mounted on the carriage 6 and an encoder scale 125 stretched on the main body side of the recording apparatus 100. An image for one scan is recorded by a recording operation of the recording heads 5 in synchronization with the movement (in the main scanning direction) of the carriage 6, and after completion of the recording for one scan, the recording medium is conveyed (in a sub scanning direction) by a predetermined pitch. This operation is repeated until recording on the entire recording medium is performed.

The recovery mechanism unit 104 is provided to maintain or recover the quality of an image to be recorded, at a normal level by eliminating a defect such as clogging of the ejection ports of the recording heads 5. The recovery mechanism unit 104 includes a wiping mechanism for wiping ejection port surfaces 40*a* and 40*b* (see FIG. 3) of the recording heads 5, a capping mechanism for covering the ejection port surfaces 40*a* and 40*b*, and a pump mechanism for sucking ink from the ejection ports. As will be described with reference to FIG. 5, the recovery mechanism unit 104 according to the present exemplary embodiment includes a slider 7 that is movable within a predetermined range while following the movement of the carriage 6 when the carriage 6 moves toward the recovery mechanism unit 104. The slider 7 is equipped with blades 8 and 9 each serving as a wiping member of the wiping mechanism, and caps 1A and 1B of the capping mechanism.

Figure 2:
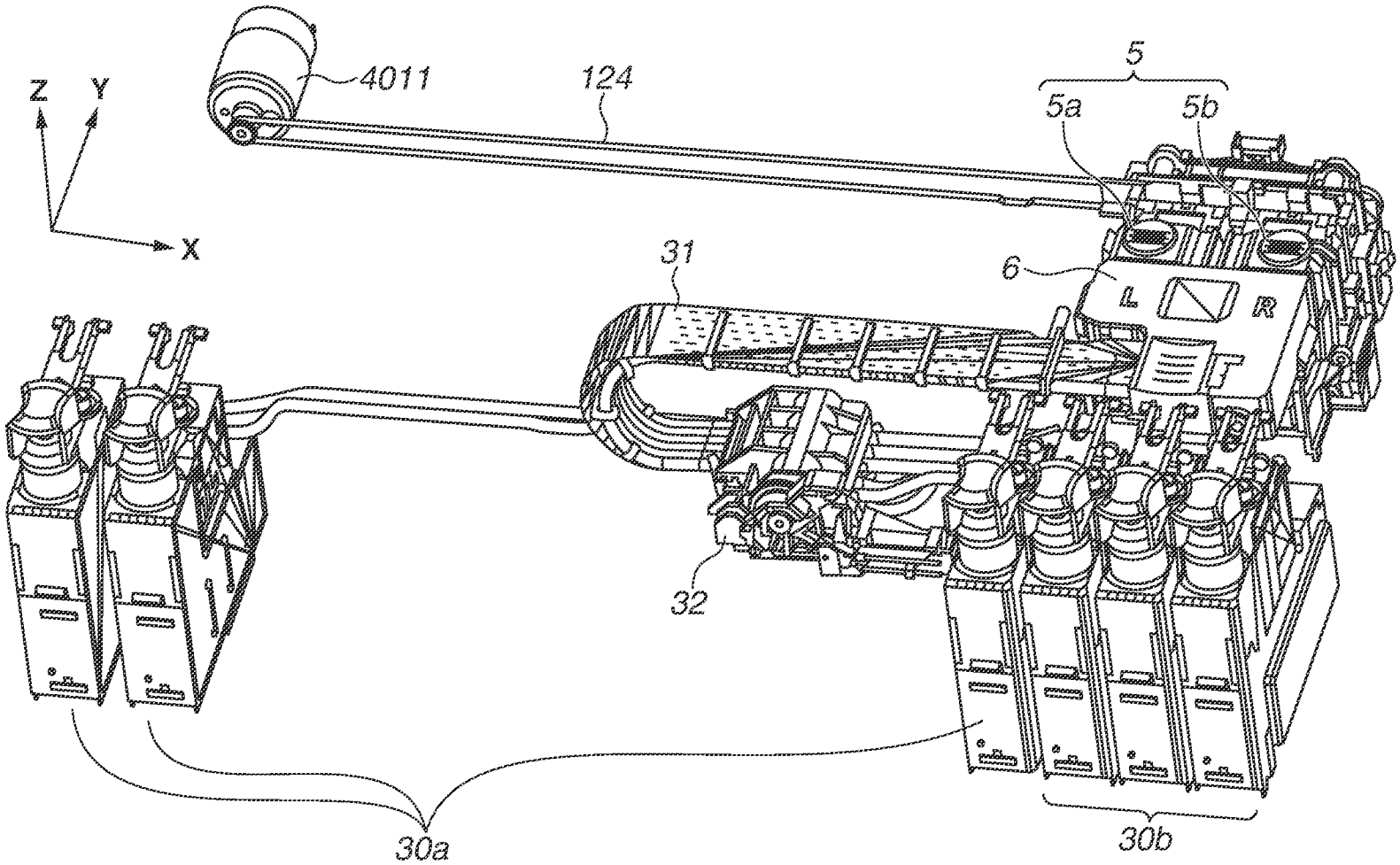
FIG. 2 is a perspective view of a supply mechanism according to the present exemplary embodiment.

FIG. 2 is a perspective view of a supply mechanism according to the present exemplary embodiment. The liquid containers 30*a* for particular color inks (black, red, and gray) are connected to the recording head 5*a* via the supply tube 31. The liquid containers 30*b* for color inks (cyan, magenta, and yellow) are connected to the recording head 5*b* via the supply tube 31. Manually moving a tube valve 32 enables the supply tube 31 to be closed.

Figure 3:
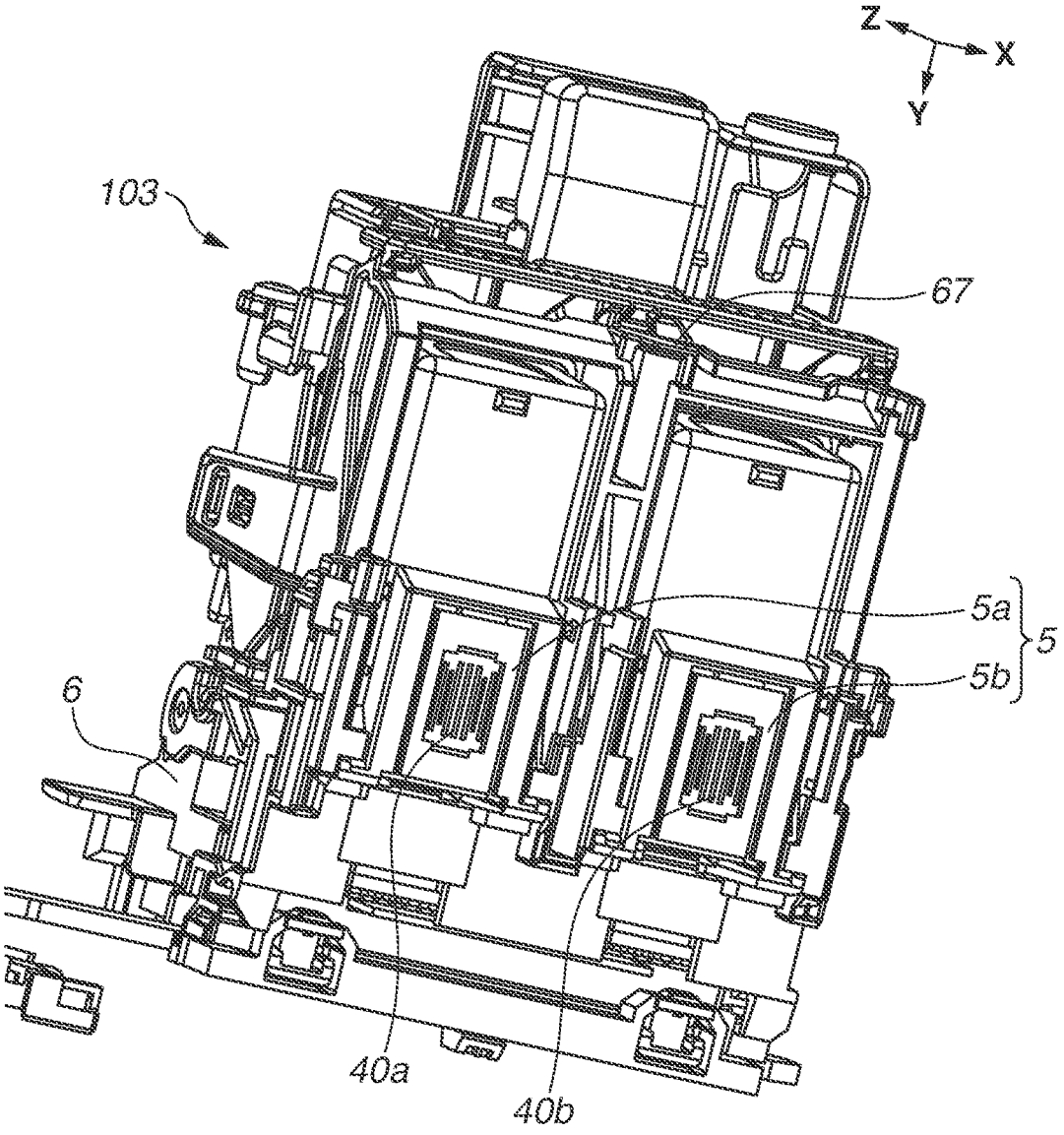
FIG. 3 is a perspective view of a recording head according to the present exemplary embodiment.

FIG. 3 is a perspective view of the recording heads 5 according to the present exemplary embodiment. As illustrated in FIG. 3, the two recording heads 5*a* and 5*b* capable of ejecting the plurality of inks are detachably mounted on the carriage 6. On the ejection port surface 40*a* of the recording head 5*a*, ejection port arrays, in each of which the ejection ports for ejecting one of the three particular color inks of black, red, and gray are arranged in a Y direction, are formed side by side in the X direction. On the ejection port surface 40*b* of the recording head 5*b*, ejection port arrays, in each of which the ejection ports for ejecting one of the three color inks of cyan, magenta, and yellow are arranged in the Y direction, are formed side by side in the X direction. Each of the ejection ports is provided with a recording element for ink ejection.

Each of the recording heads 5 according to the present exemplary embodiment is an inkjet-type recording head that ejects ink using thermal energy, and the recording element is an electrothermal converter for generating the thermal energy.

More specifically, the thermal energy generated by a pulse signal applied to the electrothermal converter causes film boiling inside the ink liquid, and foaming pressure of the film boiling is used to eject the ink from the ejection ports for recording.

The configuration of the ejection port arrays of each of the recording heads 5 is not limited thereto. For example, a configuration in which ejection port arrays for ejecting ink of one color are formed in one recording head may be adopted. Instead of the configuration in which the ink is supplied from the liquid containers 30 to the recording heads 5, a cartridge type configuration in which a recording head and a liquid container are mounted as one unit on a carriage may be adopted. Furthermore, a recording apparatus equipped with a recording head that ejects ink of one color may be used. While in the present exemplary embodiment, the recording apparatus 100 equipped with the recording heads 5 for recording an image is described as an example of an ejection apparatus, any type of ejection apparatus may be used as long as the ejection apparatus is equipped with an ejection head that ejects a liquid, and the ejection head may be, for example, a head for making a functional component. The material to be ejected is not limited to the ink as long as the material is a liquid, and the material may not be a liquid for recording an image. The liquid may be, for example, a fluid resin, or a reactant for fixing ink to a recording medium.

Figure 4:
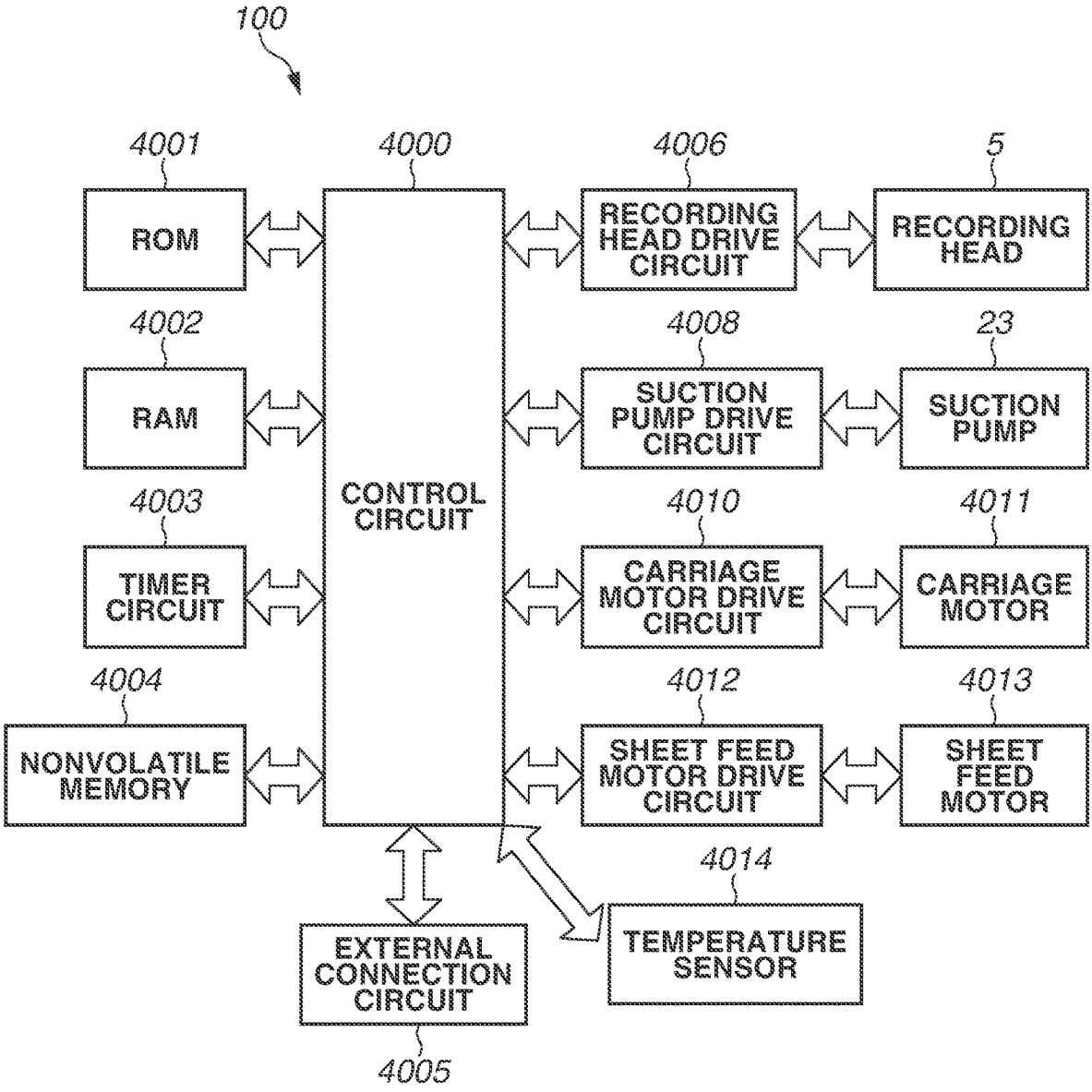
FIG. 4 is a block diagram illustrating a control configuration according to the present exemplary embodiment.

FIG. 4 is a block diagram illustrating the inkjet recording apparatus 100 according to the present exemplary embodiment. A read only memory (ROM) 4001 stores a control program to be executed, and each setting value for control. A random access memory (RAM) 4002 is a memory into which the above-described control program is loaded to be executed, stores printing data and control commands, and also stores control variables for each control. A timer circuit

4003 is capable of acquiring a current time or capable of measuring an elapsed time. A nonvolatile memory 4004 is capable of holding parameters stored in control, even in a state where the main body of the recording apparatus 100 is powered off. In the present exemplary embodiment, a time as a starting point for calculating an elapsed time is written to and read from the nonvolatile memory 4004. A control circuit 4000 executes the control program stored in the ROM 4001 or the control program loaded into the RAM 4002. A sequence to be described in the present exemplary embodiment is a part of a sequence to be executed using the above-described control program.

An external connection circuit 4005 is an interface for use in wired or wireless communication between the inkjet recording apparatus 100 and an external host apparatus, and enables the control circuit 4000 to handle information transmitted in the communication, as a control signal. The control circuit 4000 receives data of an image to be printed, from the external host apparatus via the external connection circuit 4005. The current time may be acquired from the host apparatus via the external connection circuit 4005.

A suction pump 23 is provided in the recovery mechanism unit 104, and the control circuit 4000 controls the suction pump 23 via a suction pump drive circuit 4008 to suction a desired amount of ink from each of the recording heads 5.

A temperature sensor 4014 measures a temperature of an area near the ejection ports, and a plurality of the temperature sensors 4014 is disposed at the ejection port array for each color.

The control circuit 4000 loads the received image data into the RAM 4002 and subjects the image data to image processing, thereby generating data for use in recording by the recording heads 5. Furthermore, the control circuit 4000 controls driving of each of the recording heads 5 via a recording head drive circuit 4006, based on the generated data on the RAM 4002, and simultaneously controls the carriage motor 4011 via a carriage motor drive circuit 4010. The ink is thereby ejected to a desired position on the recording medium, and scanning and recording for one scan are performed. The control circuit 4000 also controls the sheet feed motor 4013 via a sheet feed motor drive circuit 4012, thereby conveying the recording medium by a predetermined pitch. In a case where the recording apparatus 100 includes a unit capable of acquiring an image, such as a scanner, the image data may be acquired from the scanner.

Figure 5:
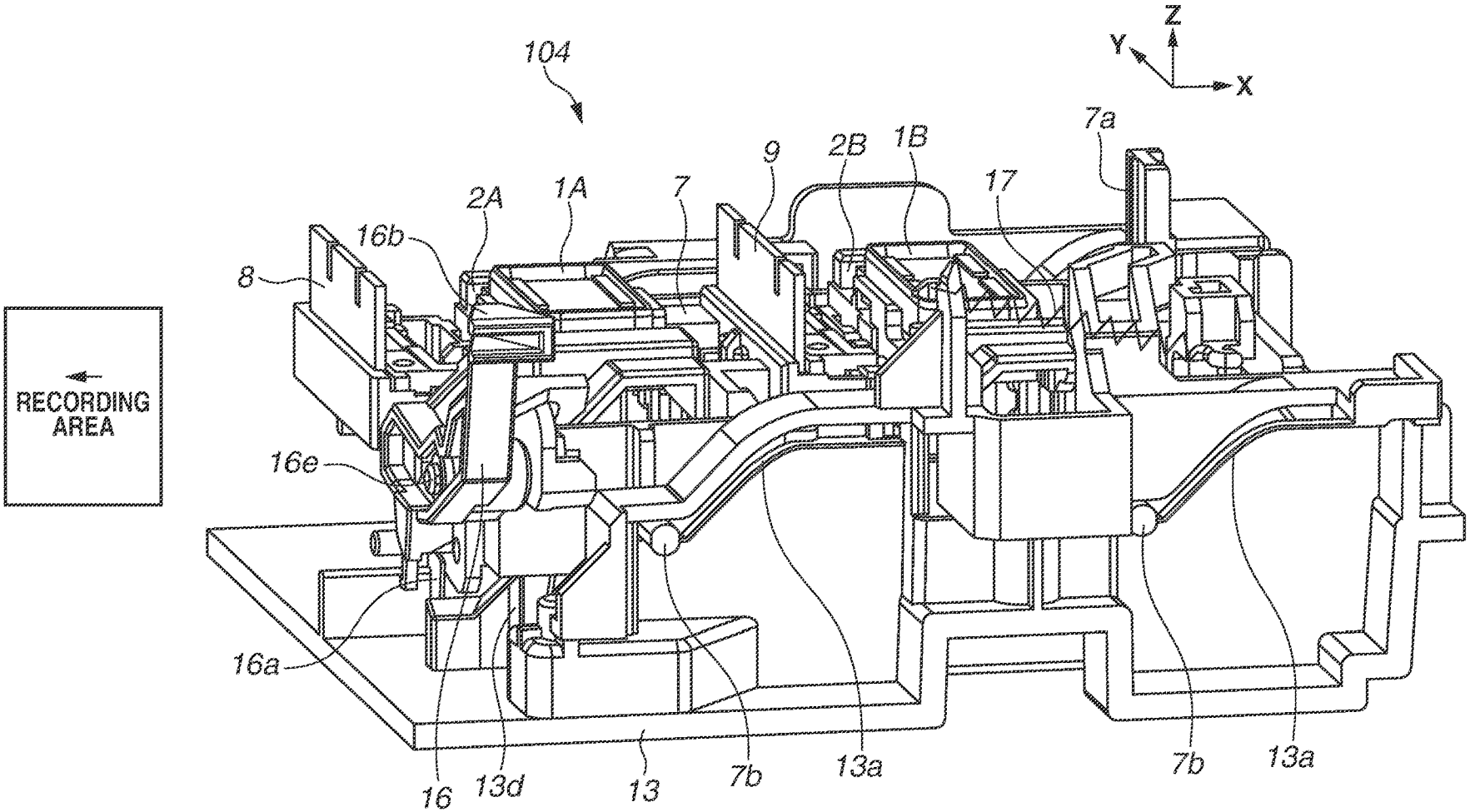
FIG. 5 is a perspective view of a recovery mechanism unit according to the present exemplary embodiment.

FIG. 5 is a perspective view of the recovery mechanism unit 104 according to the present exemplary embodiment. The slider 7 is provided with an abutting portion 7*a* configured to come into contact with a side surface of the carriage 6, in order to move within a predetermined range while following the movement of the carriage 6. In addition, the slider 7 is urged toward the −X side by a slider spring 17. The slider 7 is thereby movable from a retracted position at which the blades 8 and 9 and the caps 1A and 1B are away from the recording heads 5, to a wiping position at which the blades 8 and 9 can wipe the ejection port surfaces 40*a* and 40*b* of the recording heads 5*a* and 5*b*. The slider 7 is further movable to a capping position at which the caps 1A and 1B can cover the ejection port surfaces 40*a* and 40*b* of the recording heads 5*a* and 5*b*. Protrusion portions 7*b* protruding from a side surface of the slider 7 are provided at four positions in total to extend in the Y direction intersecting (here, orthogonal to) the moving direction of the carriage 6. The protrusion portions 7*b* provided at two positions in the −Y direction are illustrated in FIG. 5, and the protrusion portions 7*b* at the other two positions are provided in a +Y direction. The protrusion portions 7*b* at the four positions are in contact with a slider cam 13*a* disposed in a main body bottom case 13. The slider 7 is moved by the protrusion portions 7*b* at the four positions that slide along a cam surface of the slider cam 13*a* provided in the main body bottom case 13. The sliding of the protrusion portions 7*b* controls the slider 7 to be at a predetermined height with respect to the ejection port surfaces 40*a* and 40*b*, at each position (e.g., the retracted position, the wiping position, or the capping position) along the moving direction of the carriage 6.

The blade 8 for wiping the ejection port surface 40*a* of the recording head 5*a* for the particular color inks (hereinafter also referred to as the particular color recording head 5*a*) and the blade 9 for wiping the ejection port surface 40*b* of the recording head 5*b* for the color inks (hereinafter also referred to as the color recording head 5*b*) are attached to the slider 7. The caps 1A and 1B for capping the ejection port surfaces 40*a* and 40*b* are attached to cap holders 2A and 2B, respectively. Each of the cap holders 2A and 2B is attached to the slider 7 by claw portions at four positions. A cap spring is disposed between each of the cap holders 2A and 2B and the slider 7, and the cap holders 2A and 2B to which the caps 1A and 1B are attached are urged in a +Z direction toward the ejection port surfaces 40*a* and 40*b*. The blades 8 and 9 and the caps 1A and 1B are arranged in order of the blade 8, the cap 1A, the blade 9, and the cap 1B in a +X direction from the recording area side.

Figure 6:
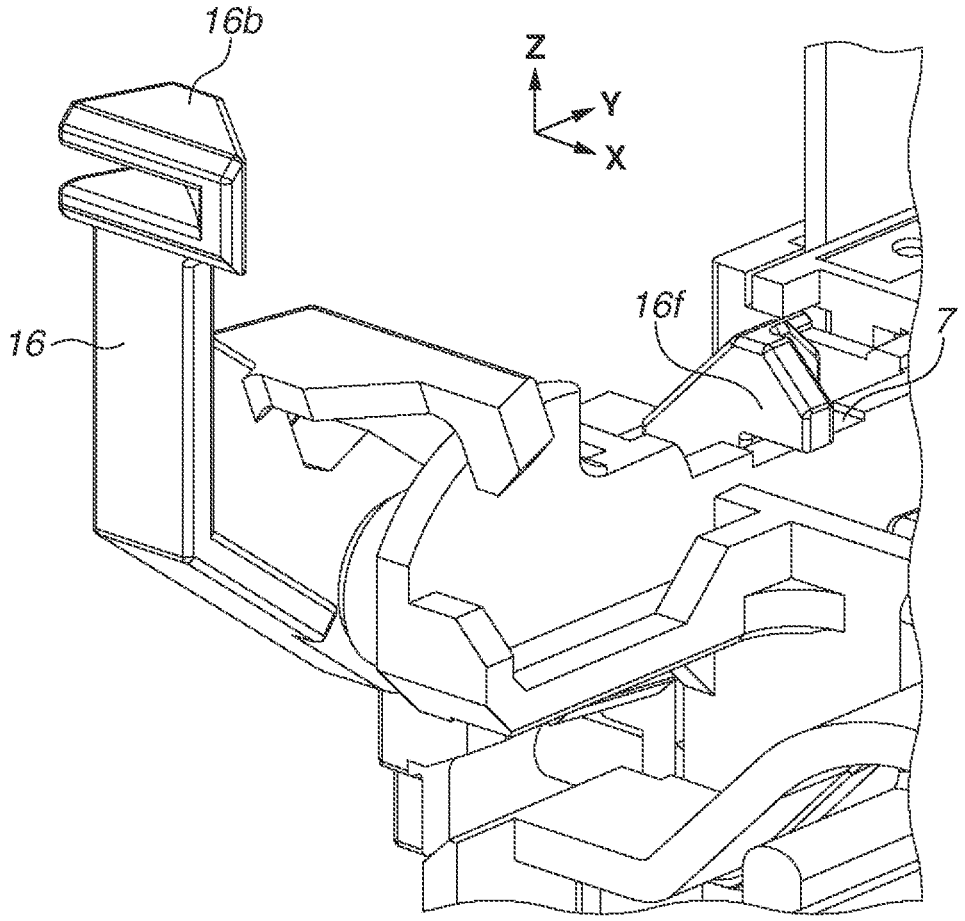
FIG. 6 is a perspective view illustrating a position of a lock lever according to the present exemplary embodiment.

As illustrated in FIG. 5, a lock lever 16 is attached onto the slider 7 at a portion on the downstream side (the −Y direction side) in the conveyance direction at an end on the recording area side, and serves as a retaining member that operates to lock (retain) the slider 7 at the wiping position. The lock lever 16 is attached to be rotatable between a retaining position for retaining the slider 7 at the wiping position and a release position for releasing the slider 7 from the retained state. The lock lever 16 operates to regulate the movement of the slider 7 so as to prevent the slider 7 from moving to the −X side and the −Z side when the carriage 6 has moved to the wiping position in order to wipe the ejection port surfaces 40*a* and 40*b* of the recording heads 5*a* and 5*b*. The lock lever 16 is supported to be rotatable within a plane in the Y direction intersecting (here, orthogonal to) the moving direction of the carriage 6. The lock lever 16 includes a supporting shaft 16*e*, and is supported to be rotatable around the supporting shaft 16*e*. Furthermore, an urging force of a torsion coil spring (not illustrated) urging the lock lever 16 to rotate counterclockwise acts on the lock lever 16, so that the lock lever 16 is held at a position to which the lock lever 16 has been moved by the urging force of the spring, unless external torque of a predetermined value or more acts thereon. At this position, a protrusion portion 16*f* of the lock lever 16 is in contact with the slider 7 (see FIG. 6).

Figure 7A:
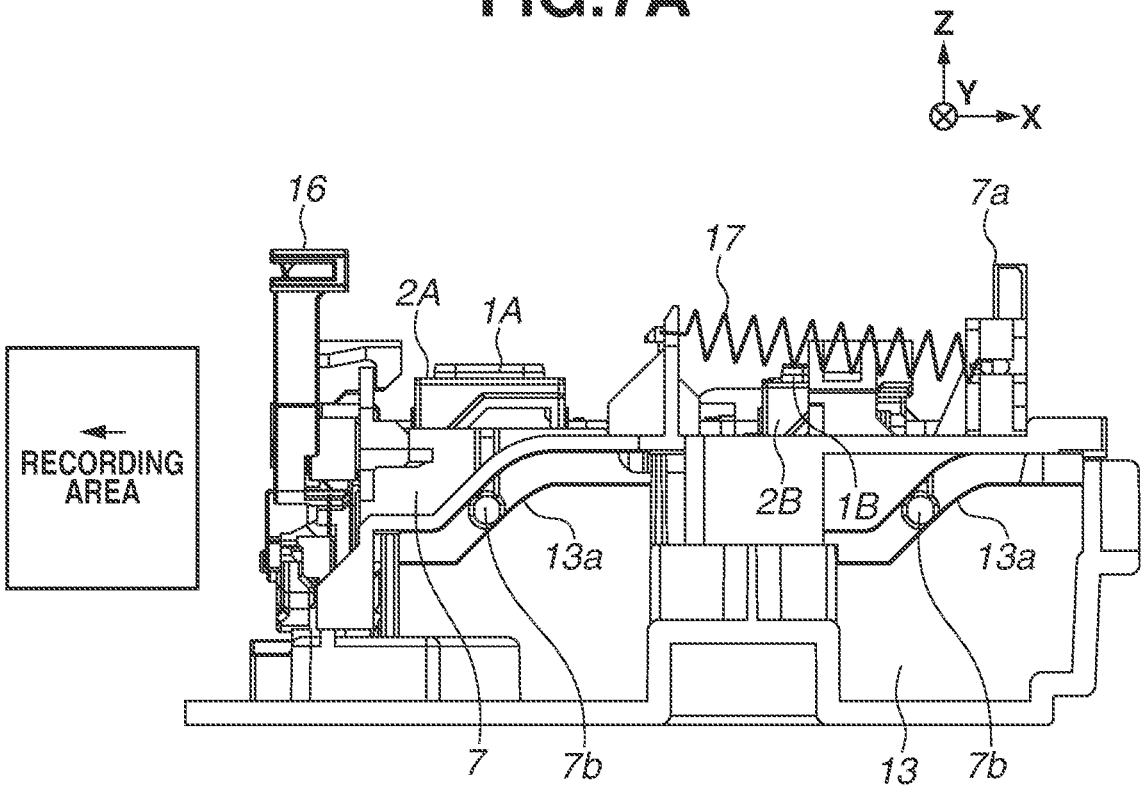
FIGS. 7A and 7B are front views each illustrating the recovery mechanism unit in a state where a slider is at a given position according to the present exemplary embodiment.
Figure 7B:
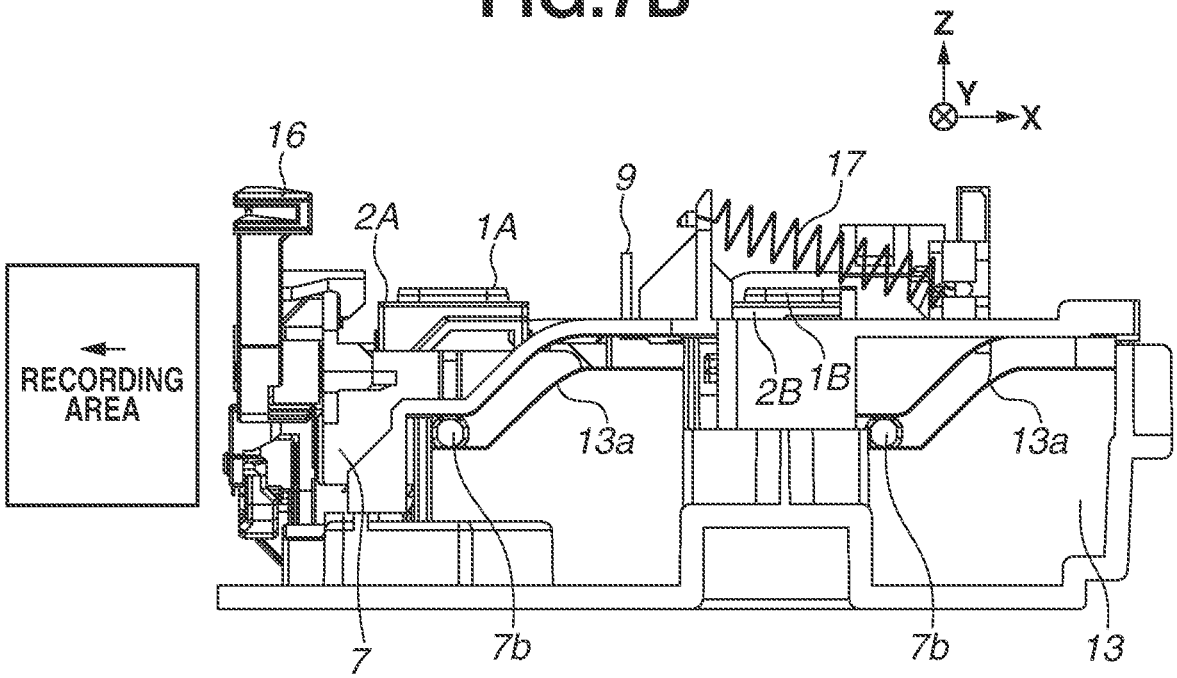

FIGS. 7A and 7B are front views each illustrating the recovery mechanism unit 104 in a state where the slider 7 is at one of the positions. On the main body side of the recording apparatus 100, a retaining portion 13*d* (see FIG. 5) is provided. The retaining portion 13*d* is capable of retaining an end surface 16*a* (see FIG. 5) of the lock lever 16 when the lock lever 16 is in a state where the protrusion portion 16*f* and the slider 7 are in contact with each other.

FIG. 7A illustrates a state of the recovery mechanism unit 104 during wiping. First, the carriage 6 moves from the recording area to the +X direction, and comes into contact with the abutting portion 7*a* to move the abutting portion 7*a* in the +X direction, thereby moving the blades 8 and 9 in the +Z direction. At the position illustrated in FIG. 7A, the end surface 16*a* of the lock lever 16 is retained by the retaining portion 13*d*, and the position of each of the blades 8 and 9 is fixed (this position will be hereinafter referred to as the wipe trigger position). In this state, the carriage 6 moves toward the recording area, so that the wiping is performed.

The carriage 6 moves to the recording area side during the wiping. The carriage 6 is provided with a protrusion portion 67 (see FIG. 3) for unlocking the lock lever 16. The protrusion portion 67 can come into contact with an upper end 16*b* (see FIG. 5) of the lock lever 16. When the carriage 6 moves toward the recording area, the protrusion portion 67 for unlocking the lock lever 16 comes into contact with the upper end 16*b* of the lock lever 16, thereby moving the lock lever 16 clockwise when viewed from the recording area side. This enables the end surface 16*a* of the lock lever 16 to leave the retaining portion 13*d*, and the lock lever 16 to be released from the retained state, so that the state transitions to a state illustrated in FIG. 7B. The blades 8 and 9 move in the −Z direction to be in a state of not being in contact with the carriage 6 and the recording heads 5, so that the carriage 6 can move to the recording area and is ready for recording.

FIG. 8 illustrates a list of carriage (CR) stop positions according to the present exemplary embodiment. As the CR stop positions related to the recovery, a cap closed position, the wipe trigger position, a wiping preliminary ejection position, a cap open position, and a wipe trigger release position are provided in this order from the home side (the +X side). For each of the CR stop positions in FIG. 8, the cap closed position is used as a reference position, and a driving amount of the carriage 6 from the reference position is indicated as the number of slits of a carriage encoder. In a case where the carriage 6 is at the cap closed position or the wipe trigger position among the CR stop positions, the caps 1A and 1B are in contact with the recording heads 5*a* and 5*b*. The recording heads 5*a* and 5*b* are not in contact with the caps 1A and 1B at the other positions. Thus, when the carriage 6 moves to the wipe trigger position immediately before the wiping, the caps 1A and 1B come into contact with the recording heads 5*a* and 5*b*, respectively. As the CR stop positions related to carriage height adjustment, a raising preparation position, a lowered position, a raised position, and a lowering preparation position are provided in this order from the home side.

FIGS. 9A to 9C are front views each illustrating what state the cap 1A and the recording head 5*a* are in when the carriage 6 is at one of the stop positions.

FIG. 9A illustrates a state where the carriage 6 is at the cap closed position. In this state, the protrusion portion 7*b* of the slider 7 is at a position closest to the home side in the slider cam 13*a*, and the cap 1A and the recording head 5*a* are in contact with each other. FIG. 9B illustrates a state where the carriage 6 is at the wipe trigger position. In this state, the protrusion portion 7*b* of the slider 7 is at a position slightly closer to the home side than an inclined portion of the slider cam 13*a*, and the cap 1A and the recording head 5*a* are still in contact with each other. Finally, FIG. 9C illustrates a state where the carriage 6 is at the wiping preliminary ejection position. In this state, the protrusion portion 7*b* of the slider 7 is located at the inclined portion of the slider cam 13*a*, and the cap 1A and the recording head 5*a* are separated from each other.

Figure 10:
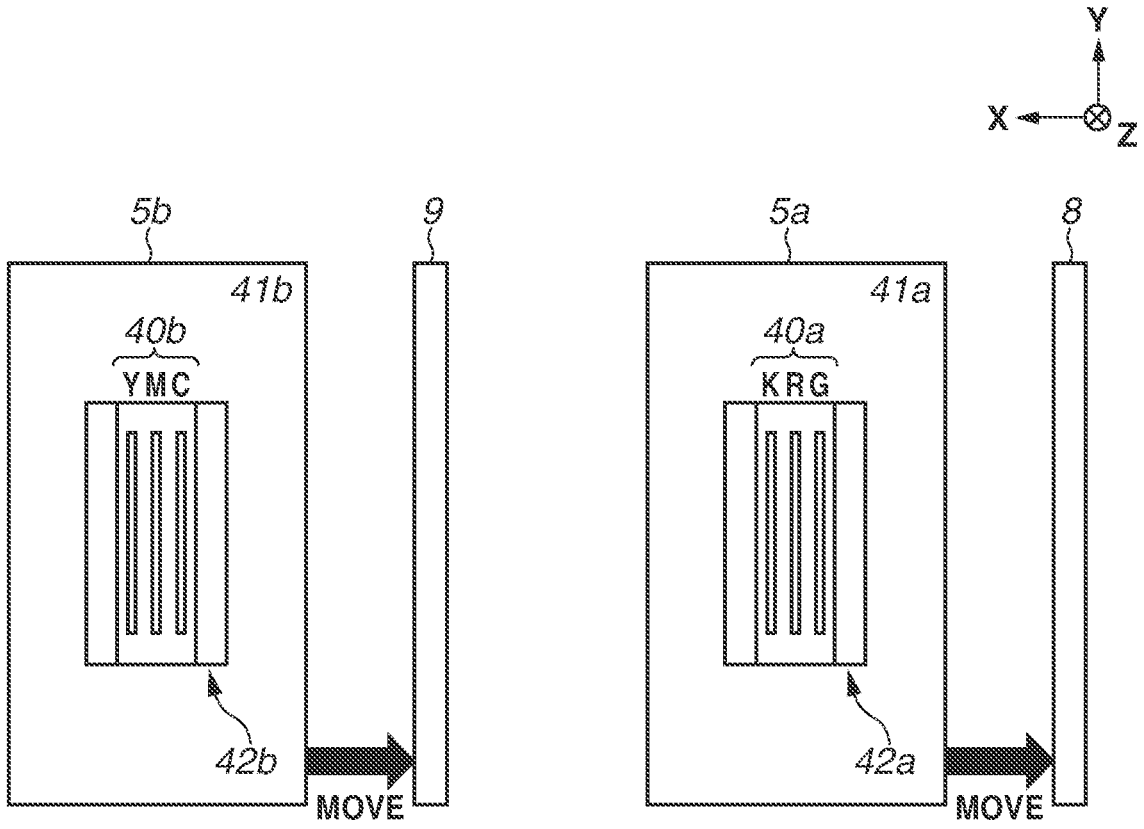
FIG. 10 illustrates a method for wiping the recording head using a blade according to the present exemplary embodiment.

FIG. 10 schematically illustrates a wiping method for wiping the recording heads 5*a* and 5*b* using the blades 8 and 9 according to the present exemplary embodiment. The particular color recording head 5*a* is provided with the ejection port surface 40*a* including the ejection port arrays for gray (G), red (R), and black (K). On the ejection port surface side, a recessed portion 42*a* is provided on each side of the ejection port surface 40*a* to sandwich the ejection ports therebetween, and a tab surface 41*a* is also provided outside the ejection port surface 40*a*. The recording head 5*a* is moved in the direction (the −X direction) parallel to the ejection port surface 40*a* by the scanning of the carriage 6, so that the blade 8 wipes the ejection port surface 40*a*, the tab surface 41*a*, and the recessed portion 42*a*. The recessed portion 42*a* is a groove extending in the direction (the Y direction) intersecting the wiping direction. The width (in the Y direction) of the blade 8 according to the present exemplary embodiment is 25 mm, and the width (in the Y direction) of the recessed portion 42*a* is 12 mm. The color recording head 5*b* has a similar configuration including a tab surface 41*b* and a recessed portion 42*b*. The details thereof will be omitted.

Figure 11:
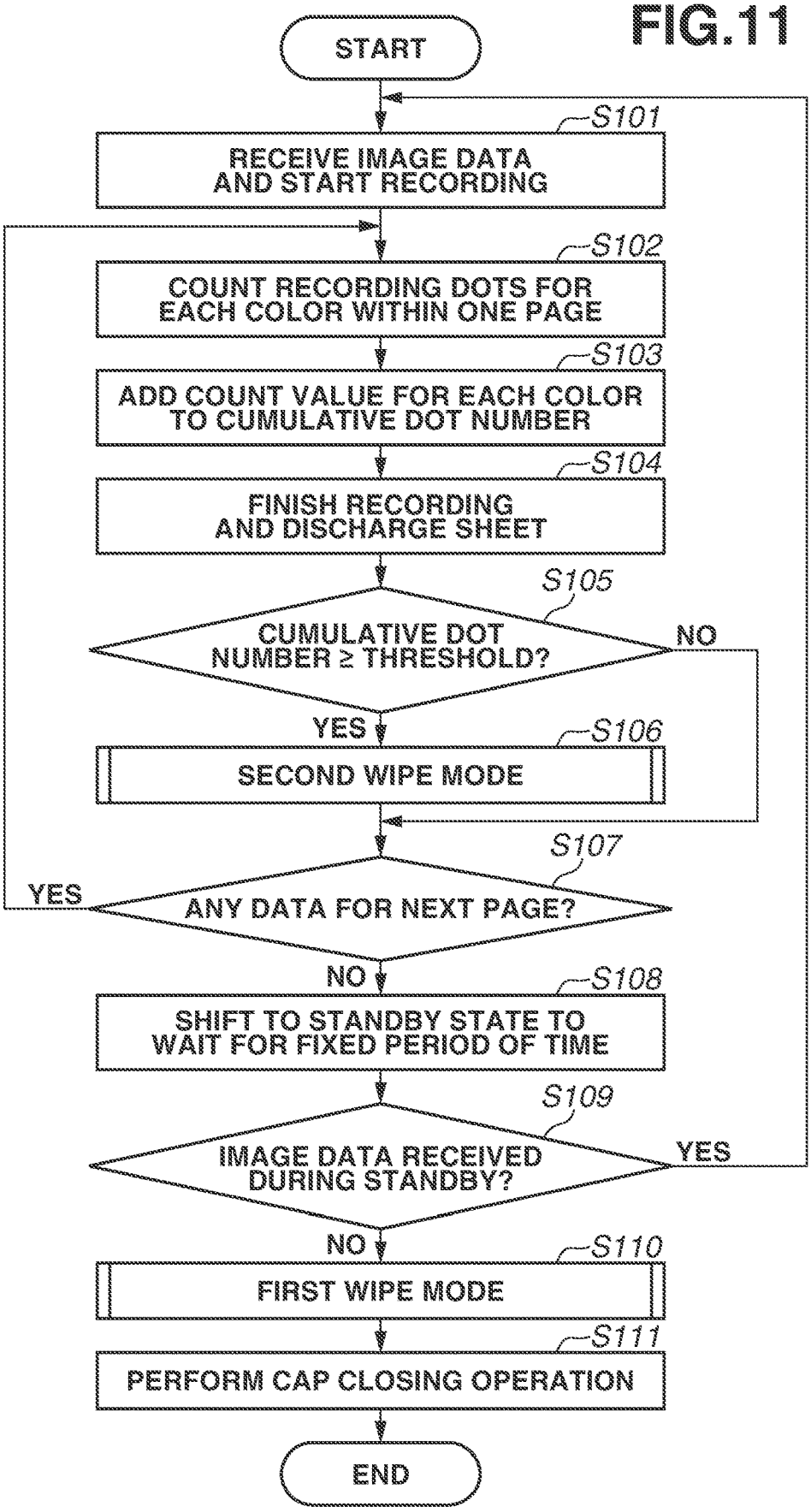
FIG. 11 is a flowchart illustrating a series of steps from a recording operation to a cap closing operation according to the present exemplary embodiment.

FIG. 11 is a flowchart illustrating a series of steps from the recording operation to a cap closing operation according to the present exemplary embodiment. Processing in FIG. 11 is implemented by the control circuit 4000 operating each of the components based on the control program stored in the ROM 4001 or the control program loaded into the RAM 4002. This processing is started when a user gives a printing instruction.

First, in step S101, the control circuit 4000 receives image data from the host apparatus. The control circuit 4000 loads the received image data into the RAM 4002, performs the image processing, and generates recording data for use in recording by the recording heads 5. The generated recording data indicates ejection or non-ejection of the ink. Based on the generated recording data, the control circuit 4000 starts the recording on the recording medium by driving the recording heads 5 via the recording head drive circuit 4006 and controlling the carriage motor 4011 via the carriage motor drive circuit 4010.

Next, in step S102, the control circuit 4000 counts, for each ink color, the number of ink ejections (recording dots) within one page of the recording medium. In step S103, the control circuit 4000 adds the count value for each ink color to a cumulative dot number for each ink color stored in the RAM 4002. The cumulative dot number is a cumulative sum of ejections of ink ejected for recording in a period after a predetermined timing and before this processing. The predetermined timing is the timing when the recording apparatus 100 is used for the first time, or the timing when the cumulative dot number is reset in step S205 in FIG. 12 or step S305 in FIG. 13 to be described below.

In step S104, upon completion of the recording on one page of the recording medium, the recording medium is conveyed while being held by the conveyance roller 121, the sheet discharge roller, and the spur roller, and is discharged to the outside of the main body of the recording apparatus 100. In step S105, the control circuit 4000 determines, for each ink color, whether the cumulative dot number calculated in step S103 is more than or equal to a threshold. If the cumulative dot number for at least one ink color is more than or equal to the threshold (YES in step S105), the processing proceeds to step S106. In step S106, the control circuit 4000 performs a wiping operation in a second wipe mode. The second wipe mode will be described with reference to FIG. 13. If the cumulative dot number for each ink color is less than the threshold (NO in step S105), the processing proceeds to step S107. In step S107, the control circuit 4000 determines if there is any data for recording on the next page. If there is any data for recording on the next page (YES in step S107), the processing returns to step S102 to start recording on the next page. If there is no data for recording on the next page (NO in step S107), the processing proceeds to step S108. In step S108, the control circuit 4000 moves the recording heads 5 to the preliminary ejection position, and shifts to a standby state where the ejection for recording is not performed for a fixed period of time. In step S109, the control circuit 4000 determines whether image data is received during standby. If the image data is received during standby (YES in step S109), the processing returns to step S101 to start the recording operation again. If the fixed period of time elapses without receipt of image data during standby (NO in step S109), the processing proceeds to step S110. In step S110, the control circuit 4000 performs the wiping operation in a first wipe mode. Then in step S111, the control circuit 4000 performs the cap closing operation and ends the processing in FIG. 11.

In the present exemplary embodiment, the number of ink ejections is counted as the cumulative dot number, but ejection amount may be counted.

Figure 12:
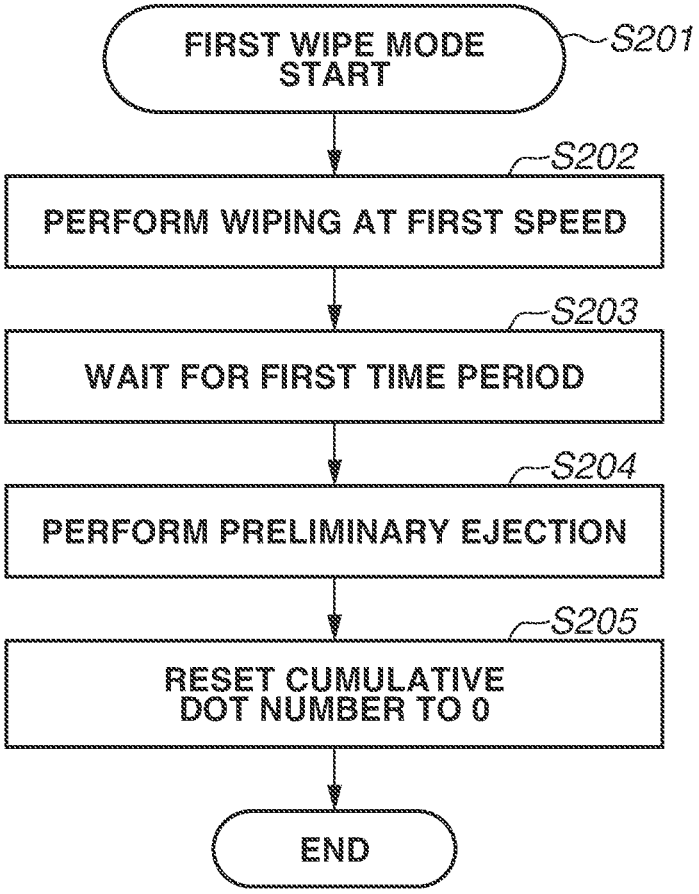
FIG. 12 is a flowchart illustrating a wiping operation in a first wipe mode according to the present exemplary embodiment.

FIG. 12 is a flowchart illustrating the wiping operation in the first wipe mode in step S110 in FIG. 11 according to the present exemplary embodiment.

In step S202, the control circuit 4000 moves the carriage 6 to the wipe trigger position described with reference to FIG. 7A, and fixes the positions of the blades 8 and 9. The control circuit 4000 then moves the carriage 6 in the −X direction toward the recording area at a first speed, and moves the carriage 6 to the wipe trigger release position. The movement of the carriage 6 in the −X direction enables the blades 8 and 9 to wipe the ejection port surfaces 40*a* and 40*b* and the tab surfaces 41*a* and 41*b* of the recording heads 5*a* and 5*b*, respectively. The wiping at the first speed is performed in this manner. While the blades 8 and 9 pass the ejection port surfaces 40*a* and 40*b*, at least the relative speed between the blades 8 and 9 and the recording heads 5 is constant, and is 127 mm per second in the present exemplary embodiment. The relative speed may be in the range of 20 mm to 130 mm per second. It is more desirable that the relative speed be in the range of 90 mm to 130 mm per second. After the wiping at the first speed, in step S203, the control circuit 4000 waits for a first time period (a first wait time). In step S204, the control circuit 4000 moves the carriage 6 to the wiping preliminary ejection position, and performs the preliminary ejection for ejecting ink not contributing to recording, from the recording heads 5 to the caps 1A and 1B. In the present exemplary embodiment, the first wait time is one second. It is desirable that the first wait time be one second or longer. Immediately after the blades 8 and 9 pass the ejection ports, an ink meniscus at the ejection ports slightly retreats and is not appropriately held. If the preliminary ejection is performed in this state without waiting, an appropriate amount of ink cannot be ejected, which can cause an ejection failure. Thus, in the present exemplary embodiment, the wait time is provided between the wiping and the preliminary ejection. In step S205, the control circuit 4000 resets the cumulative dot number to 0 since the wiping is performed in step S202.

In FIG. 11, the wiping in the first wipe mode in FIG. 12 is performed before the capping operation. Another timing for performing the wiping in the first wipe mode may be provided. For example, the wiping in the first wipe mode can be performed in cleaning performed periodically or in response to an instruction by the user in order to maintain or recover the quality of an image to be recorded, at the normal state. In such cleaning, it is important to bring the ejection state of the ejection ports into the normal state, and thus the wiping is performed in the first wipe mode in which the state of the ejection ports can be recovered. The cleaning is performed when no recording is performed and thus is less likely to impair user convenience even if it takes time to become ready for the ejection for recording.

A plurality of types of cleaning can be prepared, such as cleaning involving suction and cleaning not involving suction.

The cleaning involving suction is performed at a predetermined time interval, and the ejection port surfaces 40*a* and 40*b* of the recording heads 5*a* and 5*b* are capped by the capping mechanism. In this state, the ink is suctioned from the ejection ports by the pump mechanism. When the suction is finished, the caps 1A and 1B are opened, the wiping is performed at the first speed, and then the preliminary ejection is performed.

The cleaning not involving suction is performed in response to an instruction by the user, and the wiping is performed while the preliminary ejection is performed.

There may be cases where each of the recording heads 5 is provided with an ejection port for ejecting a small ink drop (e.g., 2 pl) and an ejection port for ejecting a large ink drop (e.g., 5 pl). In this case, the ejection state of the ink from the ejection port for ejecting a small ink drop is likely to be affected by dust or the like attaching to the corresponding ejection port surface 40*a* or 40*b* because the ink drop is small. Thus, in a case where the control circuit 4000 determines to eject small ink drops to record an image, the wiping in the first wipe mode may be performed before the recording.

Figure 13:
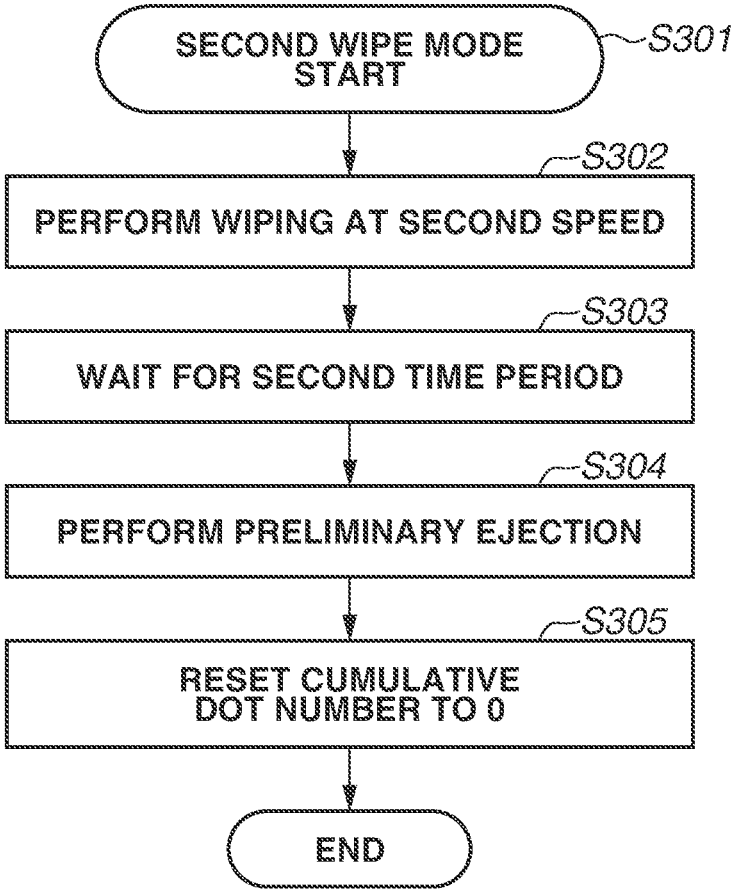
FIG. 13 is a flowchart illustrating the wiping operation in a second wipe mode according to the present exemplary embodiment.

FIG. 13 is a flowchart illustrating the wiping operation in the second wipe mode in step S106 in FIG. 11 according to the present exemplary embodiment.

In step S302, the control circuit 4000 moves the carriage 6 to the wipe trigger position described with reference to FIG. 7A, and fixes the positions of the blades 8 and 9. Then, the control circuit 4000 moves the carriage 6 in the −X direction toward the recording area at a second speed higher than the first speed, and moves the carriage 6 to the wipe trigger release position. The movement of the carriage 6 in the −X direction enables the blades 8 and 9 to wipe the ejection port surfaces 40*a* and 40*b* and the tab surfaces 41*a* and 41*b* of the recording heads 5*a* and 5*b*, respectively. The wiping at the second speed is performed in this manner. While the blades 8 and 9 pass the ejection port surfaces 40*a* and 40*b*, at least the relative speed between the blades 8 and 9 and the recording heads 5 is constant, and is 470 mm per second in the present exemplary embodiment. The relative speed is in the range of 190 mm to 470 mm per second. It is more desirable that the relative speed be in the range of 380 mm to 470 mm per second. After the wiping at the second speed is performed, in step S303, the control circuit 4000 waits for a second time period (a second wait time) longer than the first time period. In step S304, the control circuit 4000 moves the carriage 6 to the wiping preliminary ejection position, and performs the preliminary ejection for ejecting the ink not contributing to recording, from the recording heads 5 to the cap 1A and 1B. In the present exemplary embodiment, the second wait time is ten seconds. It takes time before the ink drawn from each of the recessed portions 42*a* and 42*b* to an area near the ejection ports is pulled into the ejection ports and disappear or diminish. Thus, the second wait time is longer than the first wait time. It is desirable that the second wait time be the time taken before the ink drawn to the area near the ejection ports is pulled into the ejection ports and disappear or diminish after the wiping at the second speed, and the second wait time is at least six seconds or longer. It is more desirable that the second wait time be ten seconds or longer. In step S305, the control circuit 4000 resets the cumulative dot number to 0 since the wiping is performed in step S302. By the time when the second wipe mode is finished, the ink drawn to the area near the ejection ports has disappeared or diminished, so that the ejection for recording is possible.

Figure 14B:
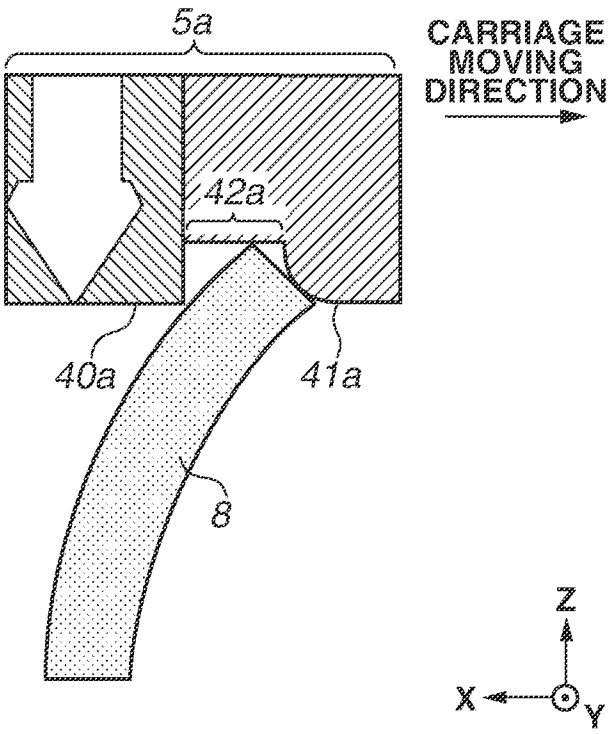
FIGS. 14A and 14B are schematic diagrams each illustrating a state of the blade with respect to an ejection port array during wiping according to the present exemplary embodiment.
Figure 14A:
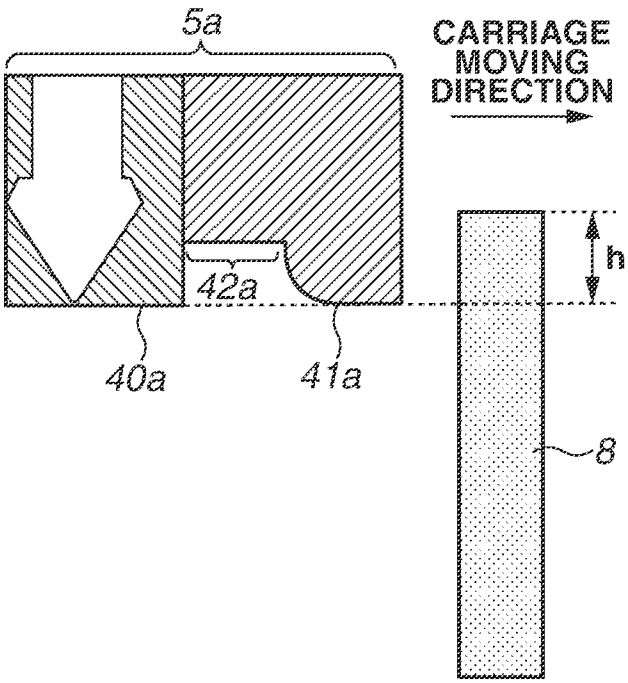

FIGS. 14A and 14B each schematically illustrate a state of the blade 8 with respect to the ejection port arrays during the wiping of the particular color recording head 5*a* according to the present exemplary embodiment. The color recording head 5*b* has a similar state and thus the description thereof will be omitted.

FIG. 14A illustrates a state where the carriage 6 is at the wipe trigger position and the position of the blade 8 is fixed, as described with reference to FIG. 7A. The tip of the blade 8 in the fixed position protrudes from the position of the ejection port surface 40*a* in the +Z direction by a length h. The length h will be referred to as the entry amount. The entry amount in the present exemplary embodiment is 1.5 mm. In this state, the carriage 6 on which the particular color recording head 5*a* and the color recording head 5*b* are mounted moves to the −X direction (the recording area side), so that the wiping is performed.

FIG. 14B schematically illustrates a state where the blade 8 is in contact with the recessed portion 42*a* during the wiping. The blade 8 is flexible and the material thereof is polyether-urethane in the present exemplary embodiment. The tip portion of the blade 8 enters into the recessed portion 42*a* by the entry amount with respect to the ejection port surface 40*a* because of the flexibility of the blade 8. The depth of the recessed portion 42*a* in the present exemplary embodiment is 0.6 mm with respect to the ejection port surface 40*a*. When the tip of the blade 8 enters into the recessed portion 42*a* in a state where the ink accumulates in the recessed portion 42*a*, the ink accumulating in the recessed portion 42*a* is drawn out along the blade 8. When the wiping is performed in a state where the ink is drawn out, the drawn out ink remains on the ejection port surface 40*a* after the wiping. States of the ejection port surface 40*a* before and after the wiping will be described with reference to FIGS. 15A to 15D and FIGS. 16A to 16C.

FIGS. 15A to 15D schematically illustrate states of the ejection port surface 40*a* before and after the wiping of the particular color recording head 5*a* in the second wipe mode according to the present exemplary embodiment. The same applies to the color recording head 5*b* and thus the description thereof will be omitted.

Figure 15A:
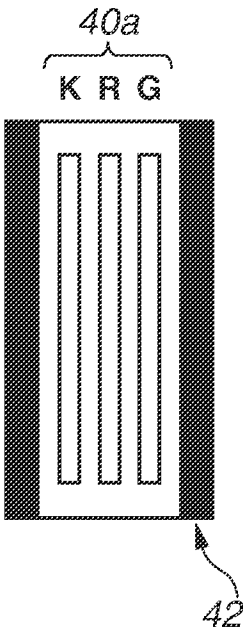
FIGS. 15A to 15D are schematic diagrams illustrating an ejection port surface before and after the wiping in the second wipe mode according to the present exemplary embodiment.
Figure 15B:
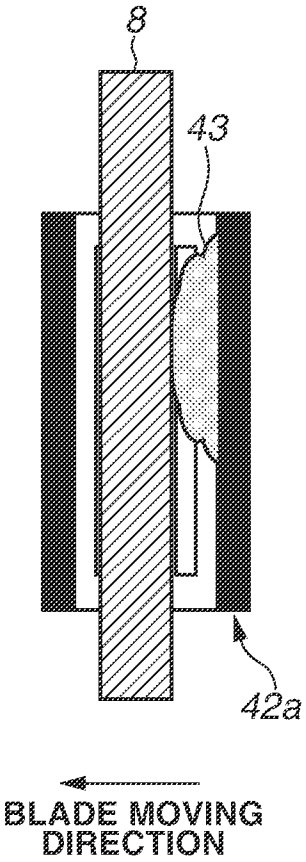
Figure 15C:
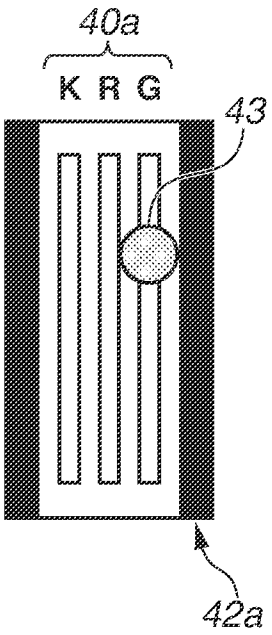
Figure 15D:
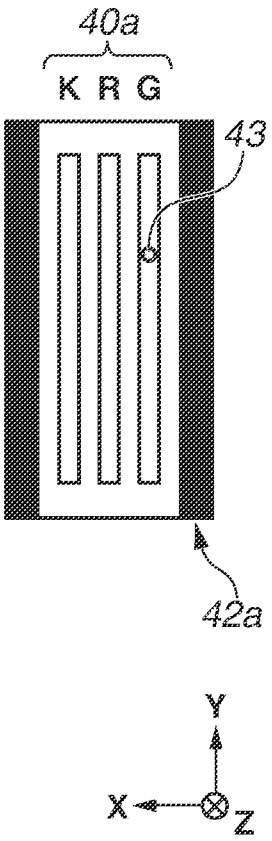

FIG. 15A illustrates the state of each of the ejection port surface 40*a* and the recessed portion 42*a* of the particular color recording head 5*a* before the wiping. In this state, ink 43 accumulates in the recessed portion 42*a*. FIG. 15B illustrates the state at a moment while the ejection port surface 40*a* is being wiped by the blade 8 for the particular color recording head 5*a*. At this moment, the ink 43 accumulating in the recessed portion 42*a* is drawn out, and the ink 43 blocks most of the ejection port array for gray (G) in the particular color recording head 5*a*. FIG. 15C illustrates the state of the ejection port surface 40*a* immediately after the wiping. The water repellent effect of the ejection port surface 40*a* of the particular color recording head 5*a* causes the ink 43 drawn out by the blade 8 to remain on the ejection port surface 40*a* as a large ink drop. Since the ink 43 blocks and covers part of the ejection port array for gray, no ink can be ejected from the blocked ejection ports, which can result in an ejection failure. If the wiping preliminary ejection is performed in this state, the ink drop further grows without ink being ejected and the ejection failure is still unresolved. On the other hand, if a certain length of wait time is provided in this state, the ink 43, which has become the large ink drop, is pulled into the ejection ports for gray and the ink drop becomes small. FIG. 15D illustrates the ejection port surface 40*a* after waiting. This is a state where the ink 43 has been pulled into the ejection ports after waiting. In this state, an ejection failure due to the ink remaining on the ejection port surface 40*a* does not occur.

Figure 16A:
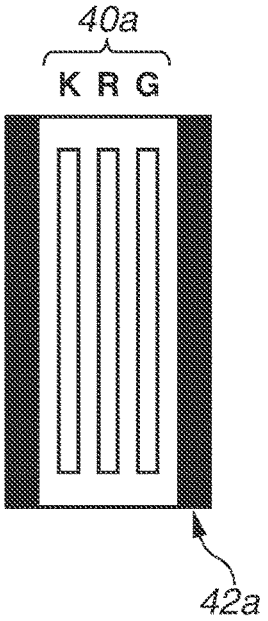
FIGS. 16A to 16C are schematic diagrams illustrating the ejection port surface before and after the wiping in the first wipe mode according to the present exemplary embodiment.
Figure 16B:
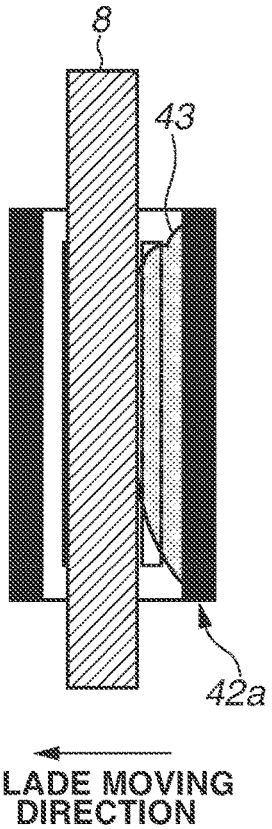
Figure 16C:
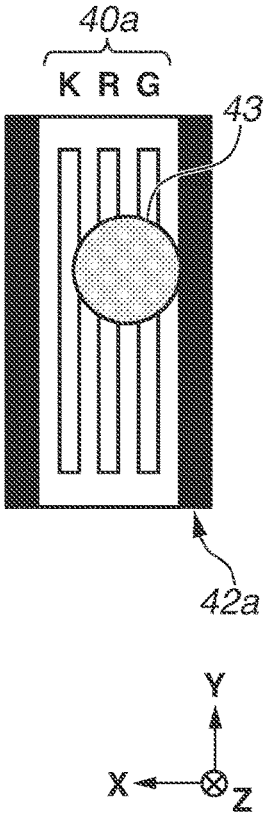

FIGS. 16A to 16C schematically illustrate states before and after the wiping of the particular color recording head 5*a* in the first wipe mode according to the present exemplary embodiment. The same applies to the color recording head 5*b* and thus the description thereof will be omitted.

FIG. 16A illustrates the state of each of the ejection port surface 40*a* and the recessed portion 42*a* of the particular color recording head 5*a* before the wiping. In this state, the ink 43 accumulates in the recessed portion 42*a*. FIG. 16B schematically illustrates the state of the particular color recording head 5*a* at a moment while the ejection port surface 40*a* is being wiped by the blade 8 for the particular color recording head 5*a*. At this moment, the ink 43 accumulating in the recessed portion 42*a* is drawn out and the ink 43 blocks most of the ejection port array for gray (G) in the particular color recording head 5*a*. The size of the blocked area is larger than that in the second wipe mode in FIG. 15B. This is because the moving speed in the wiping is low and the time during which the blade 8 enters into the recessed portion 42*a* is long, and thus the amount of the drawn ink is greater than that in the wiping in the second wipe mode. FIG. 16C illustrates the state of the ejection port surface 40*a* immediately after the wiping. The water repellent effect of the ejection port surface 40*a* of the particular color recording head 5*a* causes the ink 43 drawn out by the blade 8 to remain on the ejection port surface 40*a* as a large ink drop. The ink drop at this time is larger than the ink drop formed after the second wiping illustrated in FIG. 15C. Since the ink 43 blocks and covers part of the ejection port arrays for gray (G) and red (R), no ink can be ejected from the blocked ejection ports, which can result in an ejection failure. If the wiping preliminary ejection is performed in this state, the ink drop further grows and cannot be eliminated. However, since the cap closing operation is performed without recording after the wiping in the first wipe mode, it is not necessary to become ready for ejection immediately after the preliminary ejection. Thus, the preliminary ejection can be performed in a state where the ink drop is present. The ink 43 of the ink drop is pulled into the nearby ejection ports during the capping, so that the ink drop disappears or diminishes and no ejection due to the blocking by the ink 43 is thus resolved. The time taken before the ink drop drawn to the ejection port surface 40*a* disappears or diminishes and the ejection for recording becomes ready is longer in the first wipe mode than in the second wipe mode.

As described above, in the present exemplary embodiment, the wiping operation can be performed at two different speeds. In a case where the wiping is performed after recording on the recording medium, the wiping operation is performed in the second wipe mode in which the relative movement speed is high, so that the amount of ink drawn from the recessed portions 42*a* and 42*b* by the wiping is made small and an ejection failure in recording on the next page can be prevented. Even if the ink is drawn out during the wiping at the second speed in the second wipe mode, the ink is pulled into the ejection ports during the wait time provided after the wiping, so that an ejection failure in recording can be prevented. In a case where the wiping is performed before the capping operation, since the standby state starts without recording after the wiping, the first wipe mode in which the relative movement speed is low is performed, so that foreign matter attaching to the ejection port surfaces 40*a* and 40*b* can be satisfactorily removed.

In the above-described exemplary embodiment, a condition for performing the wiping in the second wipe mode is that in a case where the cumulative dot number exceeds the threshold, the wiping is to be performed after recording on the recording medium. However, the condition is not limited thereto. For example, the time elapsed since the last wiping may be measured, and in a case where the measured time exceeds a threshold, the wiping at the second speed may be performed after recording on the recording medium. Furthermore, both the cumulative dot number and the elapsed time may be managed, and in a case where one of these exceeds the threshold, the wiping at the second speed may be performed after recording on the recording medium.

The above-described exemplary embodiment is applicable to a facsimile, a copying machine, a word processor, and a multi-function peripheral each using the inkjet recording apparatus 100 as a recording unit, in addition to the inkjet recording apparatus 100 having a single function.

According to the above-described embodiment, it is possible to prevent the occurrence of an ejection failure while maintaining user convenience.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2021-023543, filed Feb. 17, 2021, which is hereby incorporated by reference herein in its entirety.

What is claimed is:

1. An ejection apparatus comprising:

an ejection head having an ejection port surface on which ejection ports for ejecting a liquid are arranged, and a recessed portion that is recessed lower than at least the ejection port surface and is located at a position different from a position of the ejection port surface on a side having the ejection port surface, the ejection head being configured to eject the liquid to a recording medium to perform recording on the recording medium;

a wiping member configured to wipe the ejection port surface; and a moving unit configured to move the wiping member and the ejection head relative to each other so as to move the wiping member in a first direction along the ejection port surface with respect to the ejection head, by moving at least one of the wiping member or the ejection head, wherein the wiping member performs a wiping operation for wiping the ejection head to wipe the ejection port surface after passing the recessed portion, wherein the ejection apparatus performs a first wipe mode for performing the wiping operation while moving the wiping member and the ejection head relative to each other at a first speed, and a second wipe mode for performing the wiping operation while moving the wiping member and the ejection head relative to each other at a second speed higher than the first speed, wherein in a case where the ejection apparatus performs the wiping operation after the recording on the recording medium and then performs subsequent recording on the recording medium, the ejection apparatus performs the wiping operation in the second wipe mode, and wherein in a case where the ejection apparatus performs the wiping operation after the recording on the recording medium and then performs no subsequent recording on the recording medium, the ejection apparatus performs the wiping operation in the first wipe mode.

2. The ejection apparatus according to claim 1, further comprising a cap configured to cover the ejection port surface of the ejection head, wherein in the case where the ejection apparatus performs the wiping operation after the recording on the recording medium and then performs no subsequent recording on the recording medium, the ejection apparatus performs the wiping operation in the first wipe mode before a capping operation for covering the ejection port surface of the ejection head with the cap.

3. The ejection apparatus according to claim 1, further comprising:

a cap configured to cover the ejection port surface of the ejection head; and a suction unit configured to suction a liquid from the ejection port surface, wherein in the case where the ejection apparatus performs the wiping operation after the recording on the recording medium and then performs no subsequent recording on the recording medium, the ejection apparatus performs the wiping operation in the first wipe mode after the suction unit suctions the liquid from the ejection port surface in a state where the ejection port surface is covered by a capping operation for covering the ejection port surface of the ejection head with the cap.

4. The ejection apparatus according to claim 1, wherein in the case where the ejection apparatus performs the wiping operation after the recording on the recording medium and then performs no subsequent recording on the recording medium, the ejection apparatus performs the wiping operation in the first wipe mode while performing a preliminary ejection for ejecting a liquid not contributing to the recording.

5. The ejection apparatus according to claim 1, wherein the recessed portion extends in a direction intersecting the first direction.

6. The ejection apparatus according to claim 1, wherein during the wiping operation, the wiping member wipes the ejection port surface after passing the recessed portion.

7. The ejection apparatus according to claim 1, wherein after the wiping operation in the second wipe mode, a second time period is provided as a wait time during which no liquid is ejected.

8. The ejection apparatus according to claim 7, wherein after the wiping operation in the first wipe mode, a first time period shorter than the second time period is provided as the wait time during which no liquid is ejected.

9. The ejection apparatus according to claim 7, wherein the second time period is six seconds or longer.

10. The ejection apparatus according to claim 1, wherein in the case where the ejection apparatus performs the wiping operation after the recording on the recording medium and then performs no subsequent recording on the recording medium, the ejection apparatus performs the wiping operation in the first wipe mode after performing the wiping operation in the second wipe mode.

11. The ejection apparatus according to claim 1, further comprising an acquisition unit configured to acquire information about a cumulative amount of the liquid ejected on the recording medium, wherein in a case where a value of the cumulative amount indicated by the acquired information exceeds a threshold, the ejection apparatus performs the wiping operation in the second wipe mode after completion of the recording on the recording medium.

12. The ejection apparatus according to claim 11, wherein after performing the wiping operation in the second wipe mode or the first wipe mode, the ejection apparatus resets the value of the cumulative amount indicated by the acquired information.

13. The ejection apparatus according to claim 1, further comprising a measurement unit configured to measure an elapsed time from a last time when the wiping operation is performed, wherein in a case where the time measured by the measurement unit exceeds a threshold, the ejection apparatus performs the wiping operation in the second wipe mode after completion of the recording on the recording medium.

14. A wiping method comprising:

ejecting a liquid from an ejection head having an ejection port surface on which ejection ports for ejecting the liquid are arranged, and a recessed portion that is recessed lower than at least the ejection port surface and is located at a position different from a position of the ejection port surface on a side having the ejection port surface; and wiping the ejection head using a wiping member in such a manner to wipe the ejection port surface after passing the recessed portion, wherein a first wipe mode for performing the wiping while moving the wiping member and the ejection head relative to each other at a first speed, and a second wipe mode for performing the wiping while moving the wiping member and the ejection head relative to each other at a second speed higher than the first speed are performed, and wherein in a case where the wiping is performed after the recording on the recording medium and then subsequent recording on the recording medium is performed, the wiping is performed in the second wipe mode, and wherein in a case where the wiping is performed after the recording on the recording medium and then no subsequent recording on the recording medium is performed, the wiping is performed in the first wipe mode.

15. An ejection apparatus comprising:

an ejection head having an ejection port surface on which ejection ports for ejecting a liquid are arranged, and a recessed portion that is recessed lower than at least the ejection port surface and is located at a position different from a position of the ejection port surface on a side having the ejection port surface, the ejection head being configured to eject the liquid to a recording medium to perform recording on the recording medium;

a wiping member configured to wipe the ejection port surface; and a moving unit configured to move the wiping member and the ejection head relative to each other so as to move the wiping member in a first direction along the ejection port surface with respect to the ejection head, by moving at least one of the wiping member or the ejection head, wherein the wiping member performs a wiping operation for wiping the ejection head to wipe the ejection port surface after passing the recessed portion, wherein the ejection head includes a first ejection port for ejecting a first amount of the liquid, and a second ejection port for ejecting a second amount of the liquid larger than the first amount, wherein the ejection apparatus performs a first wipe mode for performing the wiping operation while moving the wiping member and the ejection head relative to each other at a first speed, and a second wipe mode for performing the wiping operation while moving the wiping member and the ejection head relative to each other at a second speed higher than the first speed, wherein in a case where the ejection apparatus performs the wiping operation after the recording on the recording medium and then performs subsequent recording on the recording medium, the ejection apparatus performs the wiping operation in the second wipe mode, and wherein in a case where the ejection apparatus performs the recording on the recording medium by using the first ejection port, the ejection apparatus performs the wiping operation in the first wipe mode before performing the recording.

16. An ejection apparatus comprising:

an ejection head having an ejection port surface on which ejection ports for ejecting a liquid are arranged, and a recessed portion that is recessed lower than at least the ejection port surface and is located at a position different from a position of the ejection port surface on a side having the ejection port surface, the ejection head being configured to eject the liquid to a recording medium to perform recording on the recording medium;

a wiping member configured to wipe the ejection port surface;

a moving unit configured to move the wiping member and the ejection head relative to each other so as to move the wiping member in a first direction along the ejection port surface with respect to the ejection head, by moving at least one of the wiping member or the ejection head; and a cap configured to cover the ejection port surface of the ejection head, wherein the wiping member performs a wiping operation for wiping the ejection head to wipe the ejection port surface after passing the recessed portion, wherein the ejection apparatus performs a first wipe mode for performing the wiping operation while moving the wiping member and the ejection head relative to each other at a first speed, and a second wipe mode for performing the wiping operation while moving the wiping member and the ejection head relative to each other at a second speed higher than the first speed, wherein in a case where the ejection apparatus performs the wiping operation after the recording on the recording medium and then performs subsequent recording on the recording medium, the ejection apparatus performs the wiping operation in the second wipe mode, and wherein before performing a capping operation for covering the ejection port surface of the ejection head with the cap, the ejection apparatus performs the wiping operation in the first wipe mode.

17. An ejection apparatus comprising:

an ejection head having an ejection port surface on which ejection ports for ejecting a liquid are arranged, and a recessed portion that is recessed lower than at least the ejection port surface and is located at a position different from a position of the ejection port surface on a side having the ejection port surface, the ejection head being configured to eject the liquid to a recording medium to perform recording on the recording medium;

a wiping member configured to wipe the ejection port surface; and a moving unit configured to move the wiping member and the ejection head relative to each other so as to move the wiping member in a first direction along the ejection port surface with respect to the ejection head, by moving at least one of the wiping member or the ejection head, wherein the wiping member performs a wiping operation for wiping the ejection head to wipe the ejection port surface after passing the recessed portion, wherein the ejection apparatus performs the wiping operation in a first wipe mode and in a second wipe mode, wherein in a state where a liquid has been drawn out of the recessed portion to the ejection port surface by the wiping operation, a wait time is taken to allow an amount of the drawn liquid to decrease, wherein the wait time is shorter in the wiping operation in the second wipe mode than in the wiping operation in the first wipe mode, wherein in a case where the ejection apparatus performs the wiping operation after the recording on the recording medium and then performs subsequent recording on the recording medium, the ejection apparatus performs the wiping operation in the second wipe mode, and wherein in a case where the ejection apparatus performs the wiping operation after the recording on the recording medium and then performs no subsequent recording on the recording medium, the ejection apparatus performs the wiping operation in the first wipe mode.

* * * * *